US009084927B2

(12) United States Patent
Lewis et al.

(10) Patent No.: US 9,084,927 B2
(45) Date of Patent: Jul. 21, 2015

(54) INTERCHANGEABLE GRAPHIC DISPLAY SYSTEM AND METHOD OF MAKING SAME

(71) Applicants: Brian Lewis, Winthrop, MA (US); Hakeem Jimoh, Winthrop, MA (US)

(72) Inventors: Brian Lewis, Winthrop, MA (US); Hakeem Jimoh, Winthrop, MA (US)

( * ) Notice: Subject to any disclaimer, the term of this patent is extended or adjusted under 35 U.S.C. 154(b) by 0 days.

(21) Appl. No.: 14/455,223

(22) Filed: Aug. 8, 2014

(65) Prior Publication Data

US 2014/0345178 A1 Nov. 27, 2014

Related U.S. Application Data

(63) Continuation-in-part of application No. 12/936,402, filed on Oct. 5, 2010, now Pat. No. 8,800,185.

(51) Int. Cl.

| | |
|---|---|
| ***A63C 17/00*** | (2006.01) |
| ***A63C 17/26*** | (2006.01) |
| ***G09F 23/00*** | (2006.01) |
| ***G09F 7/18*** | (2006.01) |
| ***G09F 3/18*** | (2006.01) |
| *A43B 3/00* | (2006.01) |
| *A63C 17/06* | (2006.01) |

(52) U.S. Cl.

CPC . *A63C 17/26* (2013.01); *G09F 3/18* (2013.01); *G09F 7/18* (2013.01); *G09F 23/00* (2013.01); *A43B 3/0078* (2013.01); *A63C 17/002* (2013.01); *A63C 17/06* (2013.01); *G09F 2007/1856* (2013.01); *Y10T 29/49826* (2015.01)

(58) Field of Classification Search

CPC ..... A63C 17/002; A63C 17/06; A43B 3/0078
USPC ..... 40/636; 280/11.221, 11.27, 825
See application file for complete search history.

(56) References Cited

U.S. PATENT DOCUMENTS

| | | | | |
|---|---|---|---|---|
| 3,622,172 | A * | 11/1971 | Goodwin | 280/11.208 |
| 5,388,846 | A * | 2/1995 | Gierveld | 280/11.223 |
| 5,803,469 | A * | 9/1998 | Yoham | 280/11.27 |
| 2002/0011712 | A1 * | 1/2002 | Svensson et al. | 280/11.27 |
| 2004/0124692 | A1 * | 7/2004 | Oh | 301/5.1 |
| 2005/0146099 | A1 * | 7/2005 | Frazier et al. | 280/11.221 |
| 2006/0113735 | A1 * | 6/2006 | Hyser | 280/11.221 |

* cited by examiner

*Primary Examiner* — Gary Hoge
(74) *Attorney, Agent, or Firm* — Bay State IP, LLC

(57) ABSTRACT

An interchangeable graphic display system of method of using same, in conjunction with an in-line skate, roller-skate and ice-skate chassis, wherein the system includes a graphic display apparatus having a first and second layer, wherein each layer is attachable by a separate mounting means, and wherein the system enables an individual to display and replace different pictorial and graphic representations during operation of in-line skates, roller-skates and ice-skates.

20 Claims, 8 Drawing Sheets

INTERCHANGEABLE GRAPHIC DISPLAY SYSTEM AND METHOD OF MAKING SAME

CROSS REFERENCE TO RELATED APPLICATION

This application is a continuation-in-part and claims priority from and takes the benefit of U.S. patent application Ser. No. 12/936,402 filed on Oct. 5, 2010, the contents of which are hereby incorporated by reference.

BACKGROUND OF THE INVENTION

1. Field of the Invention

The present invention relates to in-line skating, roller-skating and ice-skating. Specifically, this invention concerns a means of displaying and protecting the graphics on the chassis of in-line skates, roller-skates and ice-skates, a method of preventing wear to such chassis graphics which is induced by contact with abrasive surfaces, and providing the ability to change the graphics of an in-line skate, roller-skate and ice-skate chassis.

2. Description of the Related Art

In-line skating, roller-skating and ice-skating are a forms of recreation practiced for more then two hundred years in various areas of the world. In recent times, it has evolved into a multi-faceted activity. Included among such activities are speed skating, dance, hockey, cross training, freestyle, so-called "Aggressive" skating and many more. Aggressive skating comprises of a number of stunts, including but not limiting, curb and handrail "grinding" (sliding), stair riding, ramp skating, jumping, and "stalling" (coming to an abrupt stop). Many of these activities significantly and rapidly degrade the quality of the in-line skating, roller-skating and ice-skating equipment.

As a result of the many hazards, the incorporation of graphics to the in-line skate, roller-skate and ice-skate chassis has been limited. The present approaches have been to apply graphics with either a decal or by screen-printing directly onto the chassis. These techniques insure that chassis graphics are subject to the same types of damage as the chassis itself. Also, these methods do not allow for replacing or updating the graphics of your chassis.

SUMMARY OF THE INVENTION

The present invention concerns means of displaying graphics on in-line skates, roller-skates and ice-skates chassis and protecting those graphics from direct and/or abrasive contacts or impacts. The display means of the invention comprises any method of applying graphics to a protective shield and or a separate display inserted in between the chassis and protective shield. The protective means of the invention comprise two vertical members, each of which serves to shield all or a portion of the in-line skate, roller-skate and ice-skate chassis graphics.

It is the primary object of the instant invention to provide an improved means to display and prevent such impact or abrasive damage from occurring with or to the graphics of an in-line skate, roller-skate and ice-skate chassis.

To accomplish this, an in-line skate, roller-skate and ice-skate chassis graphics display and protector has been developed. When affixed to the chassis, the potential for such damaging contacts are substantially reduced as well as allowing the user to change or update the graphics, thus increasing the life of the graphics and adding the ability of changing the look of the chassis, without having to buy an entire new chassis which can be very expensive equipment.

DESCRIPTION OF THE PREFERRED EMBODIMENT OF THE INVENTION

The present invention relates to an in-line skate, roller-skate and ice-skate chassis, graphics display and protective means ("skate chassis graphic display(s) and protector(s)") and methods for using such means to prevent damaging impacts to and/or abrasive contacts with skate chassis graphics. As used in this invention, a skate chassis display and graphic protective means is any means that displays graphics and prevents direct impact to or contact with the skate chassis graphics.

Figure 1:
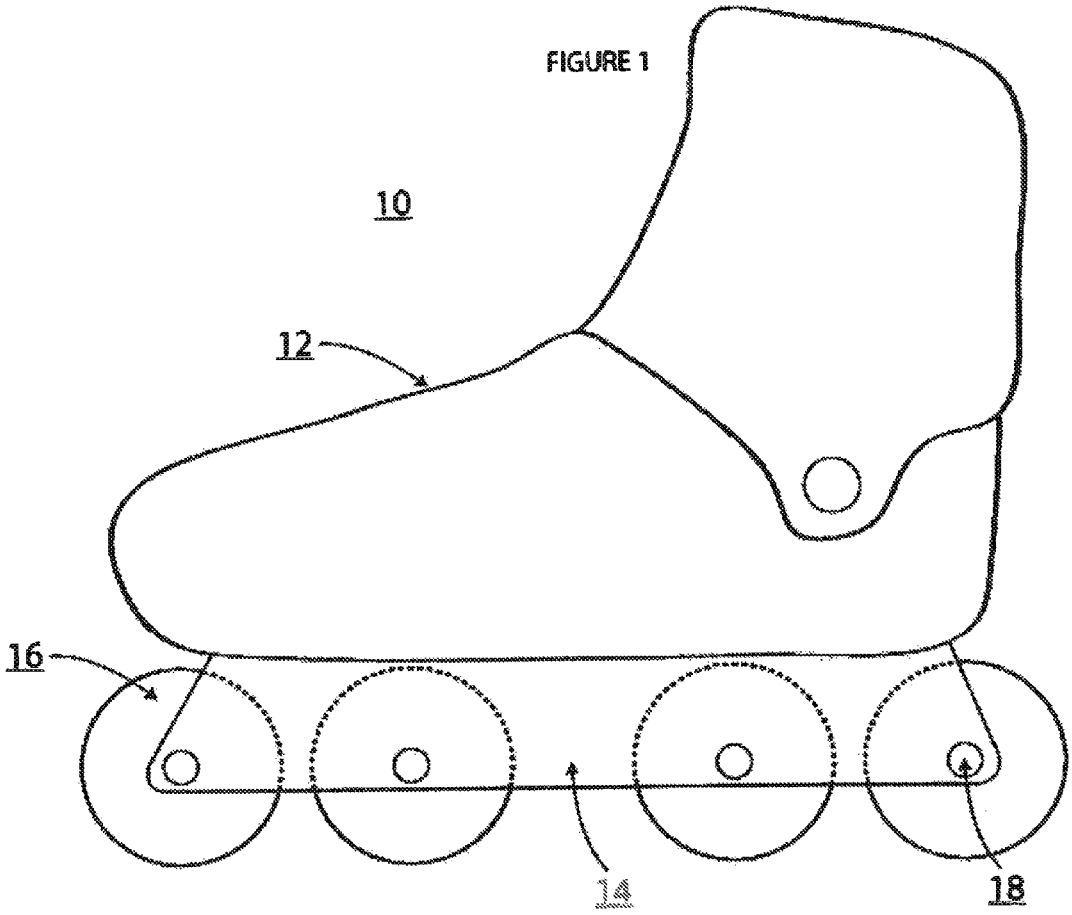
FIG. 1 is a side view of a conventional in-line skate comprising a boot, a chassis and a plurality of wheels.

FIG. 1 illustrates a known in the art in-line skate 10, wherein the in-line skate 10 consists of three basic components: a boot 12, a chassis 14, and a plurality of wheels 16. The skate boot 12 generally comprises one or more parts, which serve to secure a foot of the skater to the remaining components of the skate. The boot 12 is attached to the chassis 14 and wherein the chassis 14 holds and maintains the wheels 16. In the preferred embodiment, the wheels 16 are aligned in single file in the direction of skate travel. Furthermore, each wheel 16 is held preferably attached to the chassis 14 via an axle bolt 18. As a result of this alignment, portions of the chassis 14 are potentially exposed to impacts with various surfaces. For example, in aggressive in-line skating, the potential for such impacts is markedly increased, and when it occurs repeatedly, and/or when it occurs against an abrasive surface, graphics contained within the chassis 14 may become damaged.

Figure 2:
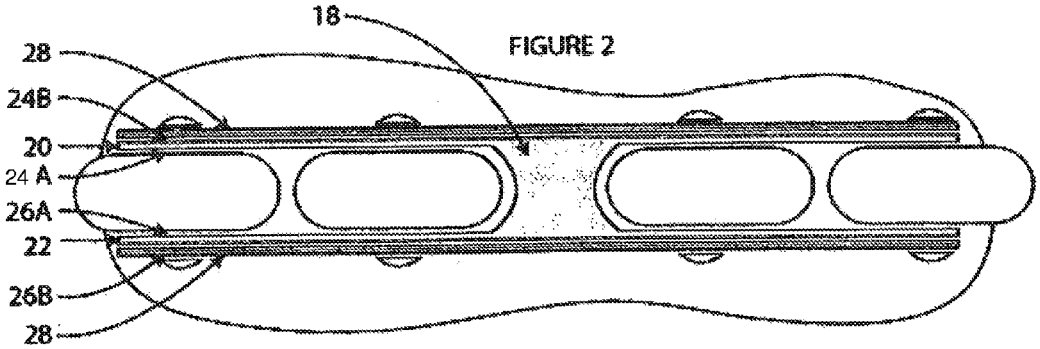
FIG. 2 is a bottom view of an in-line skate chassis, having both an inboard and outboard side, wherein a protective means is mounted to an exterior surface of sides of the chassis.

FIG. 2 illustrates a bottom view of the chassis 14 and wheels 16, wherein the chassis 14 further includes an inboard side 20 and an outboard side 22. As used herein, the side of the skate chassis 14, when attached to an in-line skate 10, nearest the inside of the boot 12 is referred to as the inboard side 20 of the chassis 14, while the outboard side 22 is that which is nearest the outside of the boot 12. Furthermore, the inboard side 20 of the chassis 14 contains an interior surface 24A and an exterior surface 24B, and the outboard side of the chassis 14 contains an interior surface 26A and an exterior surface 26B. In one embodiment of the invention, a protection means 28 is mounted to the exterior surface 24B of the inboard side 20 or the exterior surface 26B of the outboard side 24, or both sides of the chassis 14.

Figure 3:
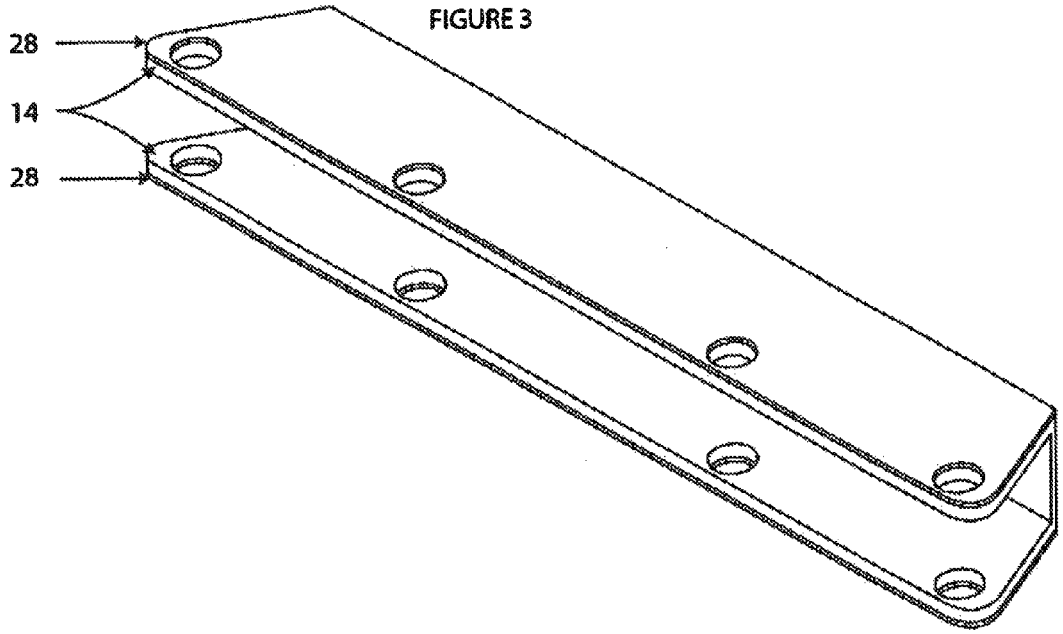
FIG. 3 is a perspective view of the skate chassis having the protective means mounted within the chassis.
Figure 4:
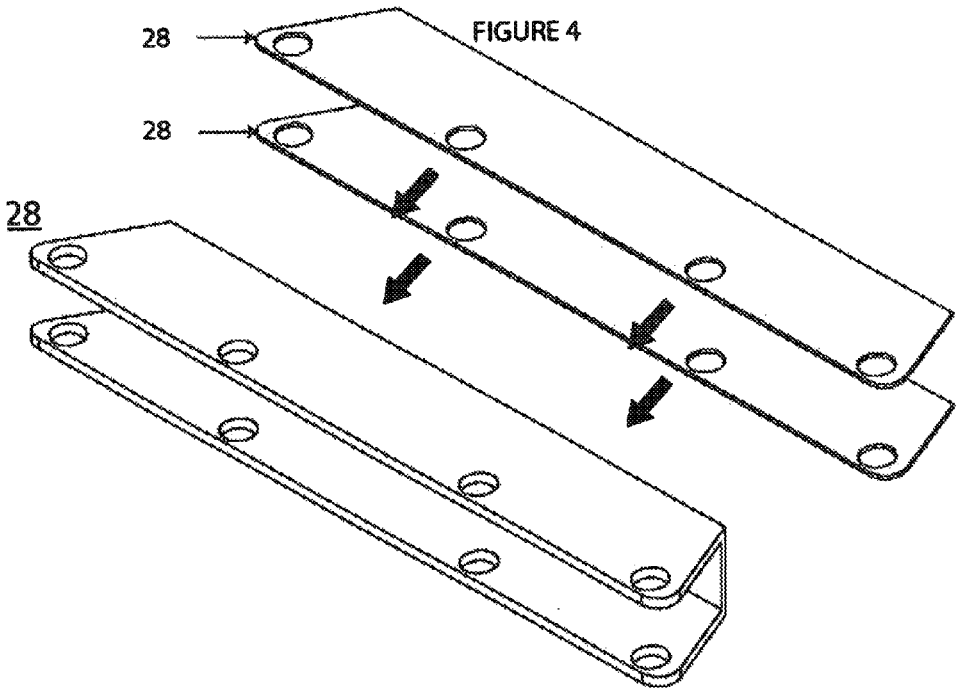
FIG. 4 is a perspective view of an alternate embodiment, wherein the protective means are separate pieces and prior to attachment to the skate chassis.

FIGS. 3 and 4 illustrates the preferred embodiment of the instant invention, wherein the protection means 28 is shown both attached to the skate chassis 14 and prior to attachment of the skate chassis 14. In this embodiment, the protection means 28 is shown and described as individual pieces, wherein each protection means 28 is mounted to the side of the chassis 14 specified by an individual user. As described below, in alternate embodiments, the actual design of the protection means 28 may vary along with the placement of the protection means 28 within the chassis 14. Herein, the protection means 28 is shown for both the inboard 20 and outboard sides 22 of the chassis 14, wherein the protection means 28 is attached from the top of the chassis 14. In alternate embodiments, the protection means 28 can be attached to the chassis 14 from any direction or angle.

Figure 5:
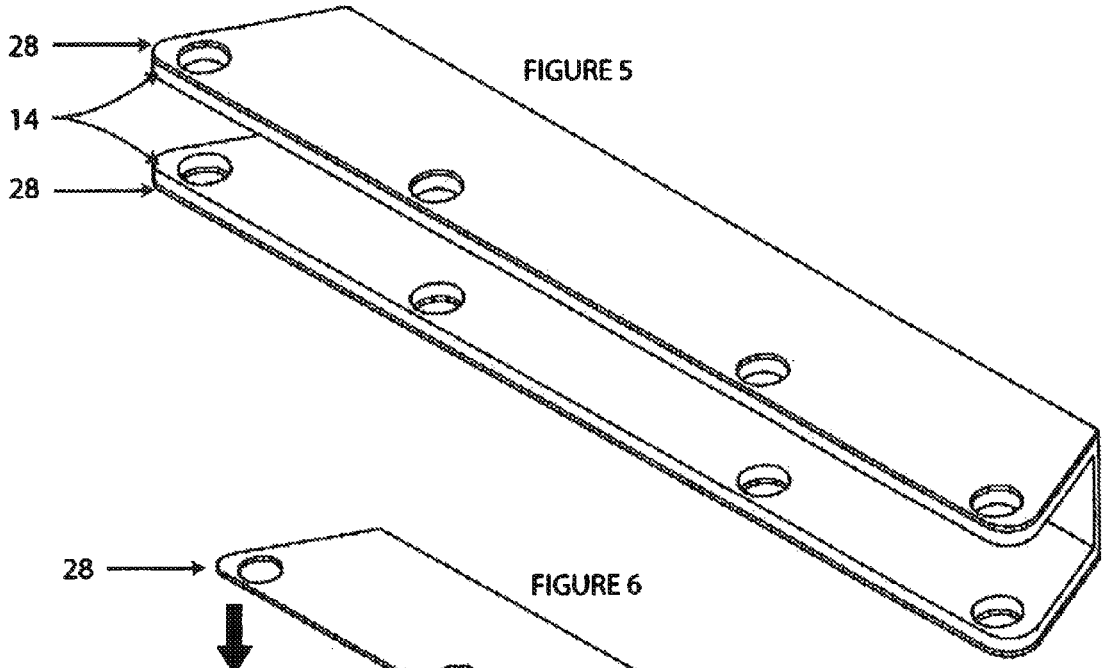
FIG. 5 is a perspective view of the skate chassis with protective means.
Figure 6:
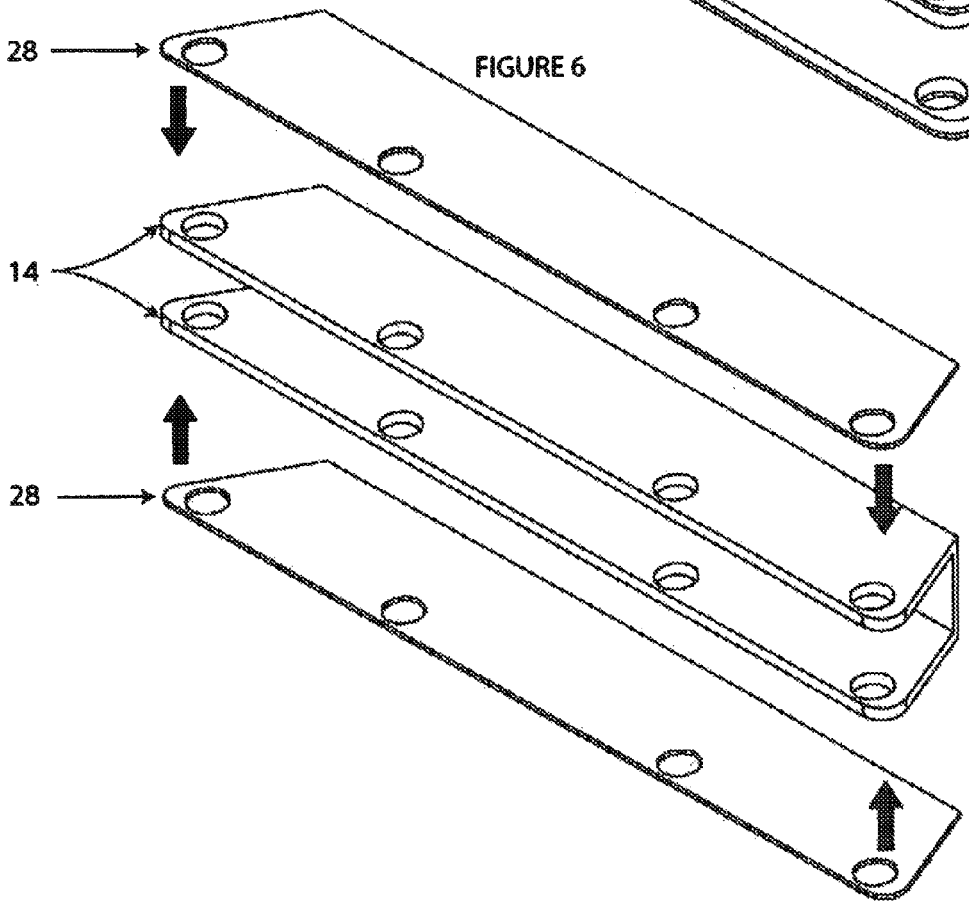
FIG. 6 is a perspective view of an alternate embodiment, wherein the protective means are separate pieces and prior to attachment to the skate chassis from the inboard and outboard side of the chassis.

FIGS. 5 and 6 illustrate an alternate embodiment of the instant invention, wherein the protection means 28 is shown both attached to the skate chassis 14 and prior to attachment of the skate chassis 14. Herein, the protection means 28 is shown for both the inboard 20 and outboard sides 22 of the chassis 14, wherein the protection means 28 is attached from the inboard side 20 and outboard side 22 of the chassis 14.

Figure 7:
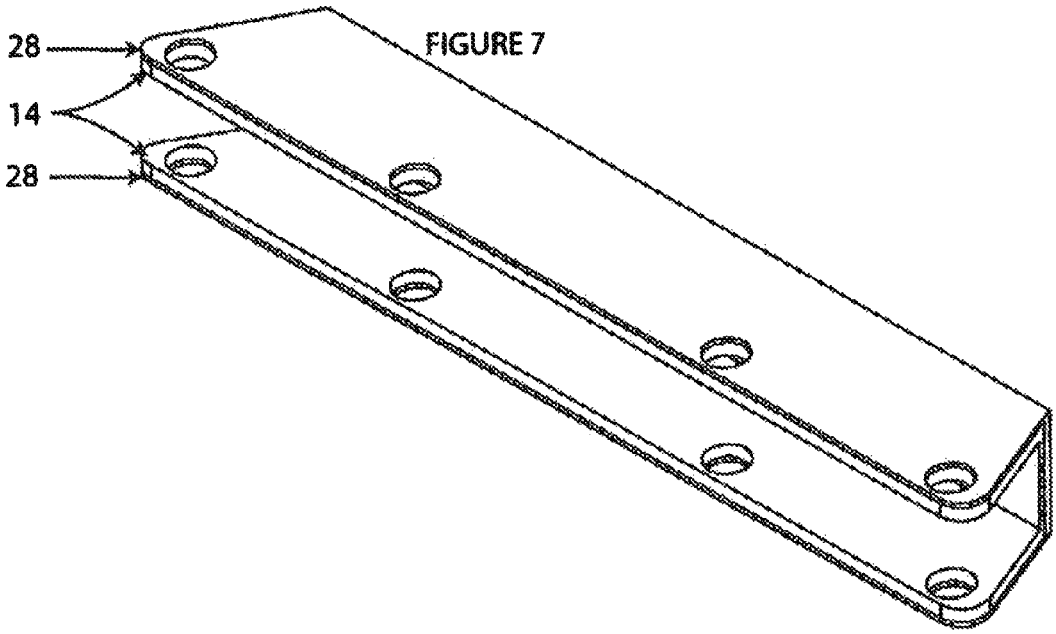
FIG. 7 is a perspective view of the skate chassis with protective means.
Figure 8:
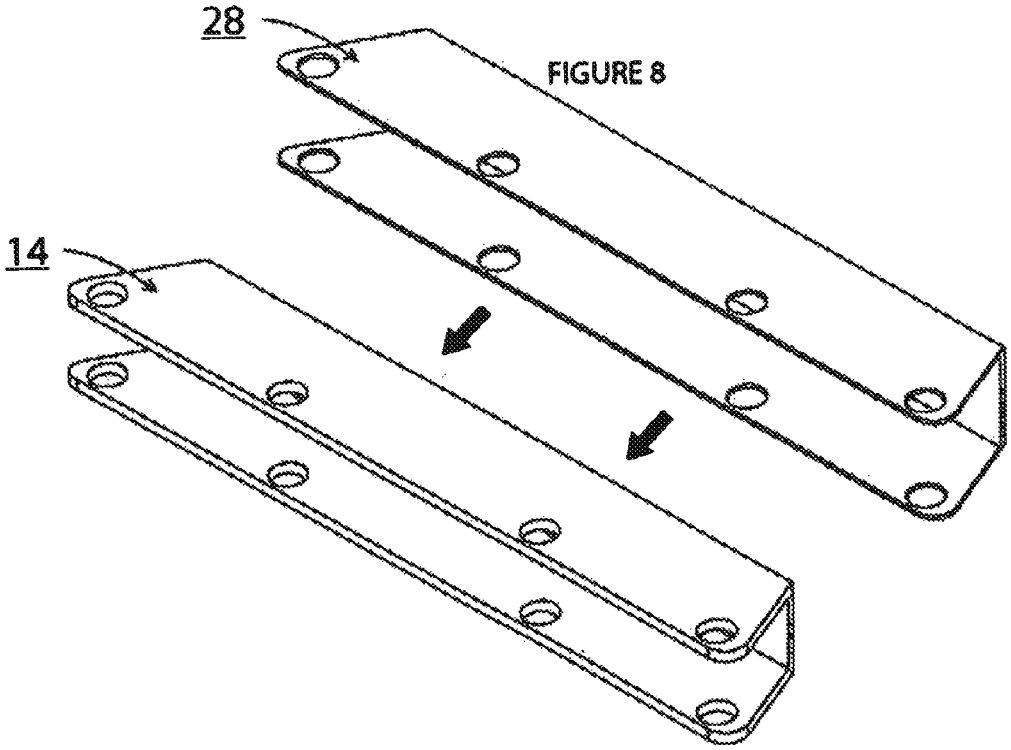
FIG. 8 is a perspective view of an alternate embodiment of the protective means, wherein the protective means is a single piece prior to attachment to the skate chassis from the top of the chassis.

FIGS. 7 and 8 illustrate yet another alternate embodiment of the instant invention, wherein the protection means 28 is shown as one single piece joined at the top, both attached to the skate chassis 14 and prior to attachment of the skate chassis 14. Herein, the protection means 28 is shown for both the inboard 20 and outboard sides 22 of the chassis 14, wherein the protection means 28 is attached from the top of the chassis 14.

Figure 9:
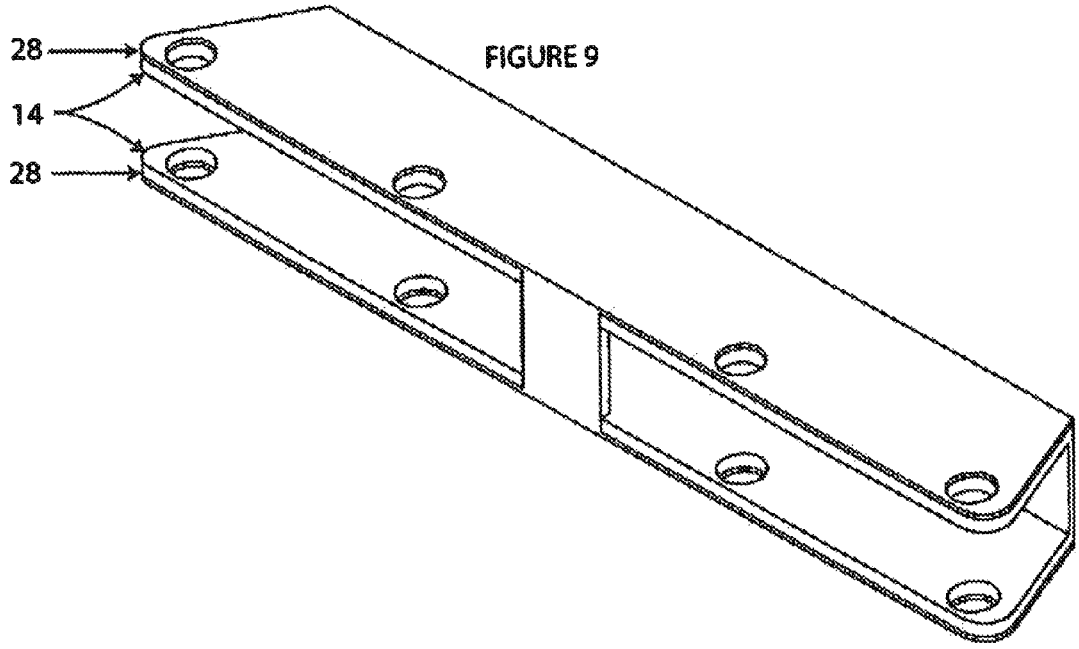
FIG. 9 is a perspective view of the skate chassis having an alternate embodiment of the protective means attached, wherein the protective means is a single piece connected at the bottom.
Figure 10:
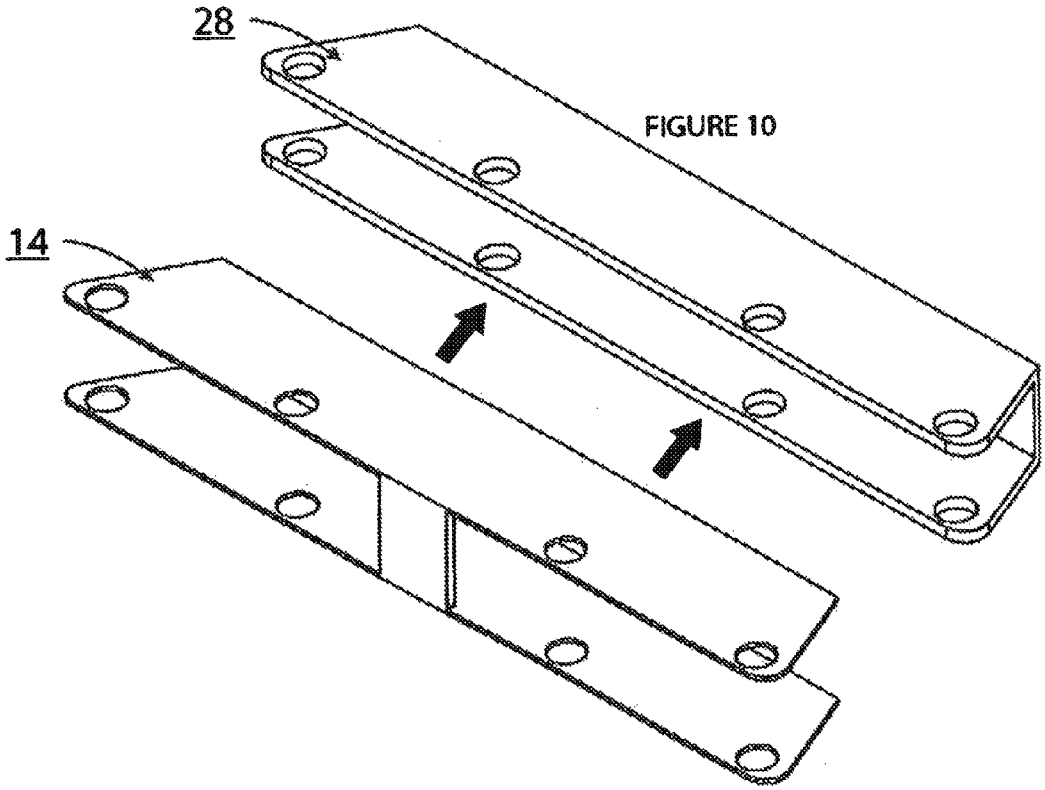
FIG. 10 is a perspective view of the protective means that are joined together from the bottom, prior to attachment of the skate chassis from the inboard and outboard sides of the chassis.

FIGS. 9 and 10 illustrate yet another alternate embodiment of the instant invention, wherein the protection means 28 is shown as one single piece joined at the bottom, both attached to the skate chassis 14 and prior to attachment of the skate chassis 14. Herein, the protection means 28 is shown for both the inboard 20 and outboard sides 22 of the chassis 14, wherein the protection means 28 is attached from the top of the chassis 14.

Figure 11:
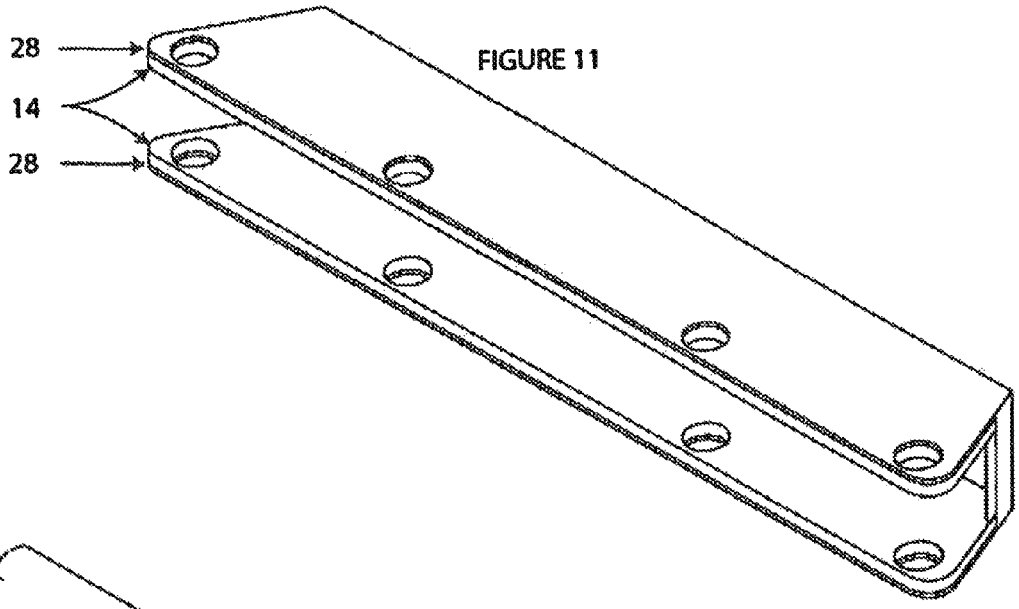
FIG. 11 is a perspective view of the skate chassis having an alternate embodiment of the protection means attached, wherein the protective means.
Figure 12:
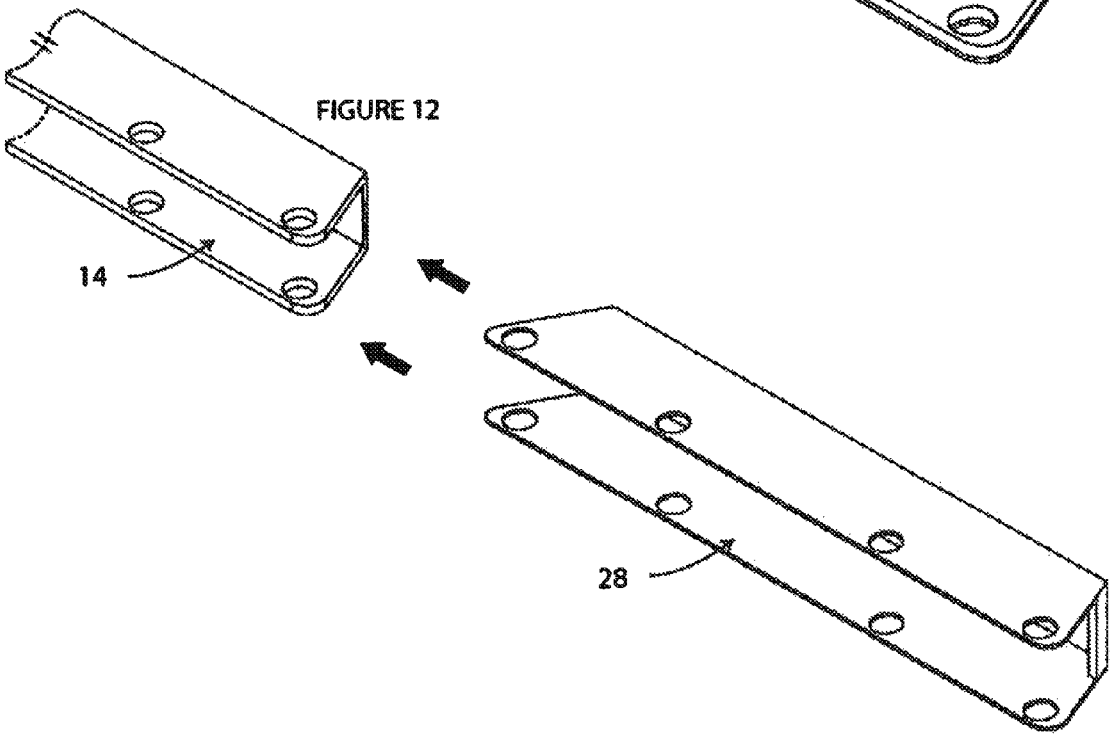
FIG. 12 is a perspective view of the protective means that are joined together from the side prior to attachment to the skate chassis.

FIGS. 11 and 12 illustrate yet another alternate embodiment of the instant invention, wherein the protection means 28 is shown as one single piece joined at the side, both attached to the skate chassis 14 and prior to attachment of the skate chassis 14. Herein, the protection means 28 is shown for both the inboard 20 and outboard sides 22 of the chassis 14, wherein the protection means 28 is attached from the side of the chassis 14.

Figure 13:
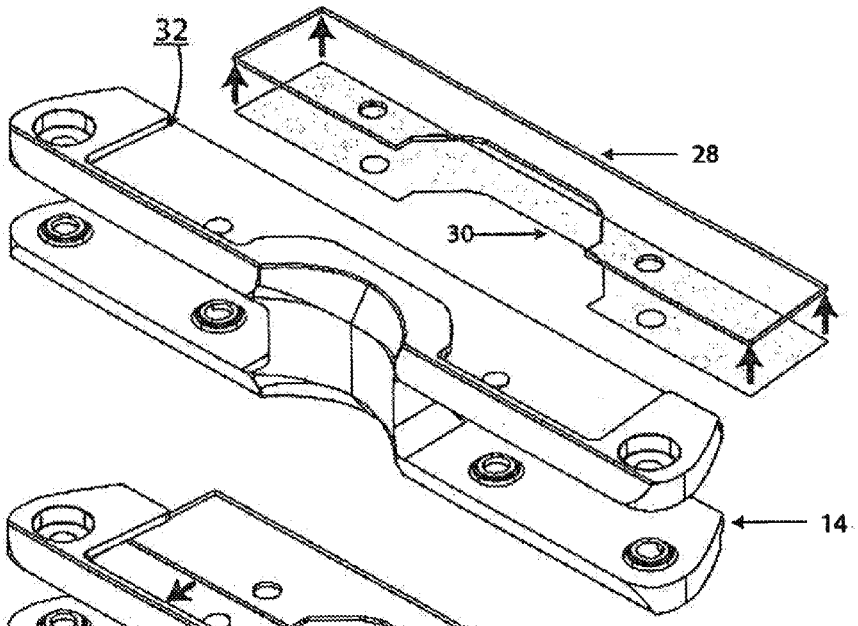
FIG. 13 is a perspective view of the instant invention prior to a graphic insert being placed between the protection means and the skate chassis.
Figure 14:
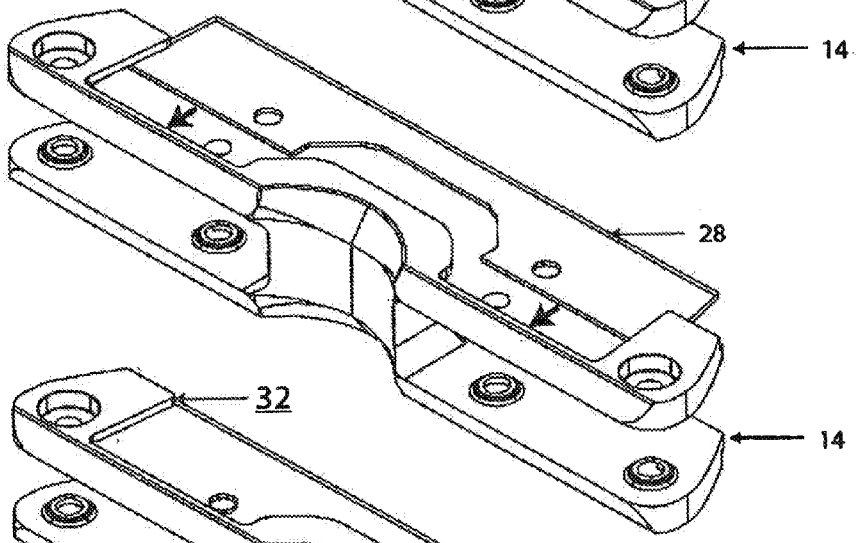
FIG. 14 is a perspective view of the instant invention during assembly of the graphic insert and protection means.
Figure 15:
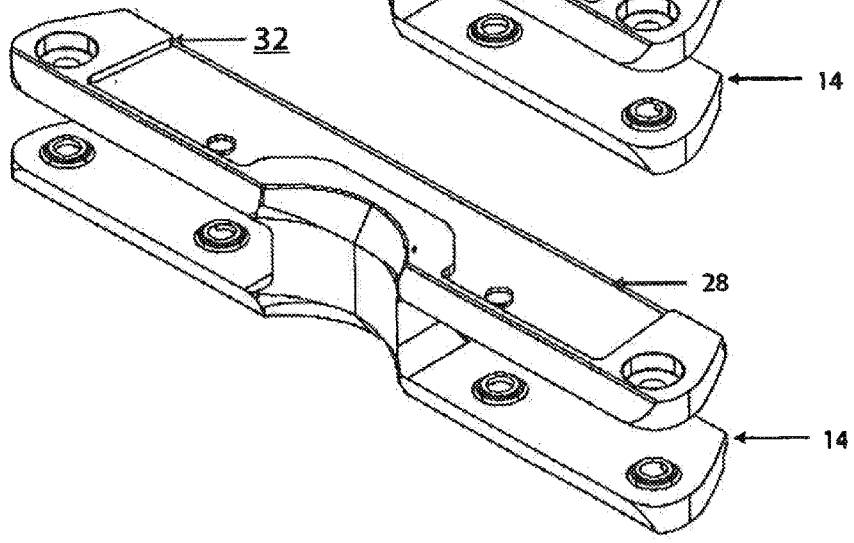
FIG. 15 is a perspective view of the instant invention fully assembled, wherein the graphic insert and protection means are attacked to the skate chassis.

FIGS. 13-15 illustrate the instant invention during all stages of assembly, wherein a graphic display 30 is placed in between the protection means 28 and chassis 14, whether it is the inboard side 20 and/or the outboard side 22.

In alternate embodiments of the instant invention, the graphic display 30 and protection means 28 may be mounted to the skate chassis 14 using wheel mounting hardware, i.e., that hardware used to attach the wheels 16 to the skate chassis 14. Such hardware may be original equipment or may be obtained from one of several after market sources familiar to those in the art. In addition, the skate chassis display 30 and protection means 28 described herein may be mounted using other mounting means independent of, or in combination with, wheel mounting hardware. Other mounting means may include but are not limited to, various types of fasteners, such as bolts, screws, etc. Interlocking systems such as slot and groove, tongue and grove, dovetail joint, etc., and adhesives, such as epoxies, glues, and other chemical agents capable of bonding a skate chassis graphic display 30 and protection means 28 according to this invention to a chassis 14. The use of wheel mounting hardware and/or other fasteners to mount a skate chassis graphic display 30 and protection means 28 affords the possibility of later removal, such as to facilitate the addition of new graphic displays 30 as well as to replace the chassis graphic protector themselves. As a result, fasteners, interlocking systems and particularly wheel mounting hardware, are preferred for mounting the displays 30 and protection means 28 described herein, as the use of adhesives typically result in permanent attachment to the chassis 14. However, also envisioned by the present invention is a skate chassis display 30 and protection means 28 comprised of more then one component. The various components of such a display 30 and protection means 28 may all be permanently affixed, removable, or a combination thereof; the display 30 and protection means 28 may also be attached to areas of a chassis 14 instead of the entire chassis 14.

As described above, the skate chassis protection means 28 can be individual pieces that are attached to the inboard side 20, the outboard side 22 or both the inboard and outboard sides 20, 22 of the chassis 14 or joined together. If the individual pieces of the protection means 28 are joined together, they may be attached at either the top, bottom, side of the protection means 28, or any combination thereof. If using an interlocking system of attachment, they may be slid together from any direction.

The skate chassis protection means 28 according to this invention can be comprised of any impact or abrasion-resistant material. Such materials include plastics, metals, wood, composite materials, i.e., fiberglass, carbon fiber, etc., in combination with an appropriate resin, and ceramics. As a variety of skate chassis 14 configurations are possible, the protection means 28 for such according to this invention will be manufactured, and machined, if necessary, to compatibly mount to such configurations. In addition, the inboard and/or outboard sides 20, 22 of the skate chassis 14 may themselves be contoured to varying degrees. The present invention contemplates manufacture and/or machining of the disclosed protectors so as to conform, as closely as is necessary to achieve proper attachment, to the contour(s) of a given skate chassis 14.

The graphic displays 30 can be located on the inboard or outboard side 20, 22 of the protection means 28, the inboard or outboard side of the chassis 14, in between the protective means 28 and the chassis 14, or any combination. The graphic displays 30 according to this invention can be applied any number of ways, such as screen-printing, stickers or decals, removable inserts, video displays, any type of lighting, etc. The removable inserts are the preferred means since they allow for the replacing and updating of the chassis graphics. The inserts can be any type of computer printed graphics, handmade art such as drawings, paintings, etc., photographs, etc. These inserts can also be made out of any material such as plastics, metals, wood, composite materials, i.e., fiberglass, carbon fiber, etc., in combination with an appropriate resin, and ceramics.

Furthermore, the chassis 14 can be any of the many styles and types of skate chassis 14. They consist of but are not limited to in-line skating, roller-skating and ice-skating, etc. These chassis can be made out of many different materials. Such materials include plastics, metals, woods, composite materials, i.e., fiberglass, carbon fiber, etc., in combination with an appropriate resin, and ceramics.

In the preferred embodiment of the instant invention, the protection means 28 is an individual transparent plastic protector on both the inboard 20 and outboard sides 22 of each chassis 14. These protectors slide into groves 32 from the top of the chassis (see FIGS. 13-15) and are then held firmly into place by the hardware used to attach the wheels 16. The graphic displays 30 are placed between the chassis 14 and the protection means 28 before the wheel hardware is attached. In an alternate embodiment, the protection means 28 are also recessed into the chassis for additional protection (see FIGS. 13-15).

Therefore, by attaching the graphic displays 30 and the protection means 28 as described throughout in this way, both the graphics 30 and the protection means 28 can inexpensively be replaced; this not only makes the product last longer but also gives the consumer the ability to change the look of the chassis without purchasing a whole new chassis which can be very costly.

Figure 16:
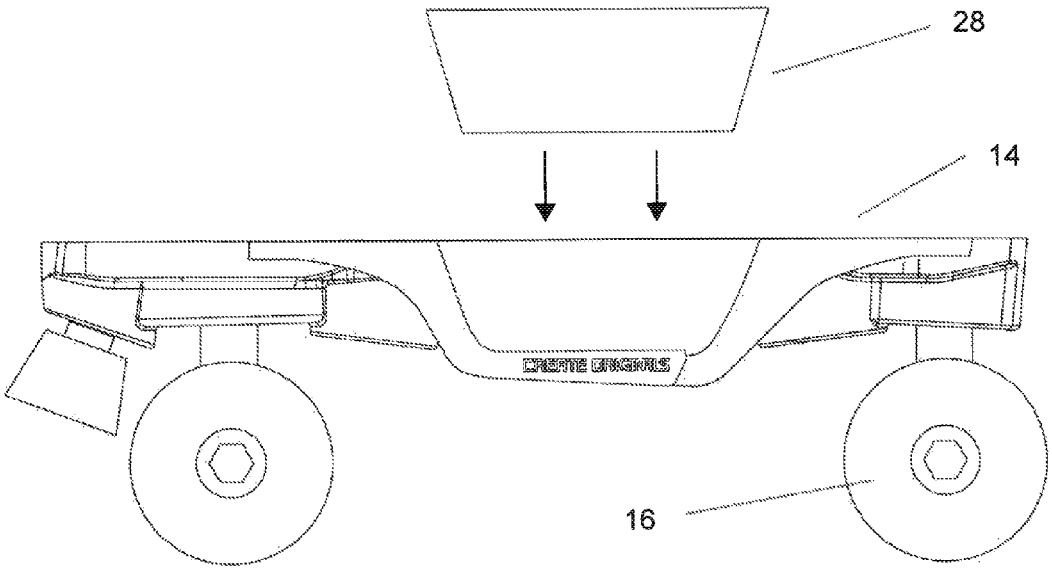
FIG. 16 is a side view of the instant invention, wherein the graphic insert is for use on a roller skate.

FIG. 16 illustrates yet another alternate embodiment of the instant invention, wherein the skate is comprised of a roller skate. In this embodiment the protection means 28 is constructed to fit with the chassis 14 of a roller skate.

Figure 17:
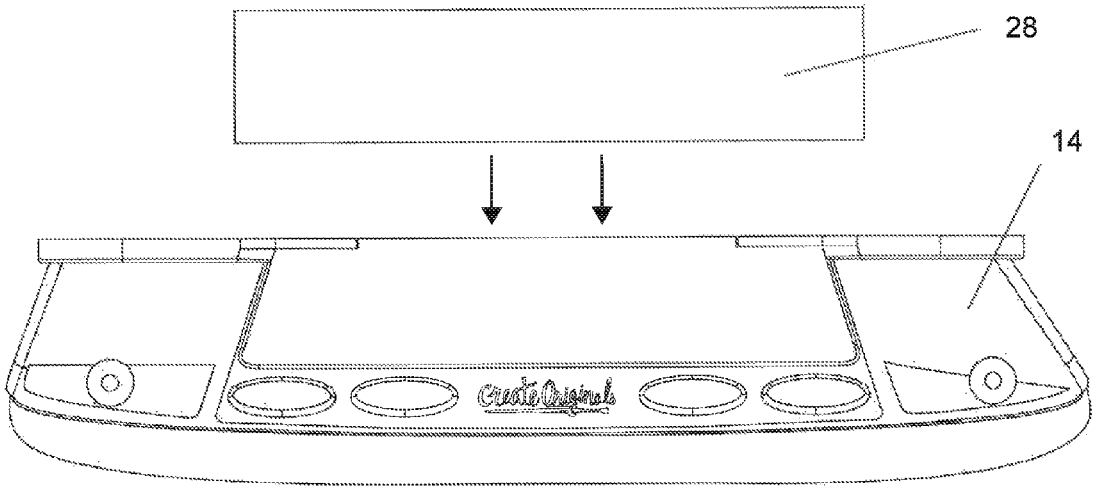
FIG. 17 is a side view of the instant invention, wherein the graphic insert is for use on an ice skate.

FIG. 17 illustrates yet another alternate embodiment of the instant invention, wherein the skate is comprised of an ice skate. In this embodiment the protection means 28 is constructed to fit with the chassis 14 of an ice skate.

The invention claimed is:

1. An interchangeable graphic display system comprising:
a skate, wherein the skate comprises:
a boot;
a chassis; and
a plurality of wheels;
a protection display apparatus that abuts the chassis, wherein said display apparatus further comprises:
a protection means, and
a graphics display;
a mounting means for joining said protection means to said graphics display;
a second mounting means for joining the protection display apparatus to said chassis of said skate; and
a recessed portion of said chassis, such that said protection display apparatus is receivable and securable in said recessed portion during operation of said skate by an individual.

2. The graphic display system of claim 1, wherein said chassis further includes an inboard side and an outboard side to attach the protection display apparatus and wherein the protection means is mounted to an exterior surface of the inboard side and an exterior surface of the outboard side.

3. The graphic display system of claim 1, wherein said protection means is made out of a material selected from the group consisting of plastic, metal, wood, fiberglass and carbon fiber.

4. The graphic display system of claim 1, wherein said graphics display further comprises a removable insert attachable to said protection means, wherein said removable insert contains a graphic or other pictorial representation.

5. The graphic display system of claim 4, wherein said removable insert is attachable to said protection means by an application means.

6. The graphic display system of claim 5, wherein the application means for the removable insert is selected from the group consisting of stickers, and decals.

7. The graphic display system of claim 4, wherein the graphic representation on said removable insert is selected from the group consisting of computer printed graphics, handmade drawings, paintings and photographs.

8. The graphic display system of claim 1, wherein the chassis of said skate is selected from the group consisting of flat rocker, anti-rocker, suspension and freestyle.

9. The graphic display system of claim 1, wherein the chassis of said skate is made out of material selected from the group consisting of plastic, wood, fiberglass, and carbon fiber.

10. The graphic display system of claim 1, wherein the skate is selected from the group consisting of in-line skates, roller skates, and ice skates.

11. A method of displaying interchangeable graphics on a skate chassis, utilizing an interchangeable graphic display system having a protection display apparatus that abuts the chassis, wherein said display apparatus further comprises a protection means, a graphic display, a mounting means for joining said protection means to said graphics display and a second mounting means for joining said graphics display to said chassis of said skate, the steps comprising:

a) selecting a graphic to be displayed on a skate chassis;
b) attaching said graphic to said protection means by an application means;
c) attaching said protection means to said graphic display by a mounting means to create a graphic display apparatus;
d) placing said graphic display apparatus onto said chassis of said skate by aligning said apparatus within said chassis; and
e) attaching said graphic display apparatus to said chassis by a second mounting means.

12. The method of claim 11, wherein said protection means is made out of a material selected from the group consisting of plastic, metal, wood, fiberglass, and carbon fiber.

13. The method of claim 11, wherein said protection means further comprises a removable insert attachable to said protection means, wherein said removable insert contains a graphic or other pictorial representation.

14. The method of claim 11, wherein said removable insert is attachable to said protection means by an application means.

15. The method of claim 14, wherein the application means for the removable insert is selected from the group consisting of screen-printing, stickers, and decals.

16. The method of claim 15, wherein the graphic representation on said removable insert is selected from the group consisting of computer printed graphics, handmade drawings, paintings and photographs.

17. The method of claim 16, wherein the chassis of said skate is selected from the group consisting of flat rocker, anti-rocker, suspension and freestyle.

18. The method of claim 17, wherein the chassis of said skate is made out of material selected from the group consisting of plastic, wood, fiberglass and carbon fiber.

19. The method of claim 18, wherein the chassis of said skate is selected from the group consisting of in-line skates, roller skates, and ice skates.

20. An interchangeable graphic display system consisting of:

a skate, wherein the skate includes a boot, a chassis and a plurality of wheels;

a protection display apparatus that abuts the chassis, wherein said display apparatus further comprises:

a protection means; and a graphics display, wherein said graphics display consists of a removable insert attachable to said protection means, wherein said removable insert contains a graphic or other pictorial representation;

a mounting means for joining said protection means to said graphics display;

a second mounting means for joining said graphics display to said chassis of said skate; and a recessed portion of said chassis, such that said protection display apparatus is receivable and securable in said recessed portion during operation of said skate by an individual.

* * * * *